US006383096B1

(12) United States Patent
Green

(10) Patent No.: US 6,383,096 B1
(45) Date of Patent: May 7, 2002

(54) SYSTEM AND METHOD FOR SOCCER NET INSTALLATION

(76) Inventor: Robert Rex Green, 15 Paradise Plaza #153, Sarasota, FL (US) 34239

( * ) Notice: Subject to any disclaimer, the term of this patent is extended or adjusted under 35 U.S.C. 154(b) by 0 days.

(21) Appl. No.: 09/636,375

(22) Filed: Aug. 11, 2000

(51) Int. Cl.[7] ..... A63B 63/00; A63B 67/00

(52) U.S. Cl. ..... 473/415

(58) Field of Search ..... 473/415, 476, 473/478, 451, 435, 416; 273/400

(56) References Cited

U.S. PATENT DOCUMENTS 5,476,266 A 12/1995 Caruso

*Primary Examiner*—Paul T. Sewell
*Assistant Examiner*—M. Chambers
(74) *Attorney, Agent, or Firm*—Dorothy S. Morse

(57) ABSTRACT

A strong, durable, easy-to-use, and relatively low in cost installation system and method that allow soccer nets to be quickly installed and removed from a soccer goal frame. The system can be easily incorporated into new soccer goal frames during manufacture, or retrofitted to existing frames. The system and method use one or more support cords attached to the top and side edges of the soccer net, in addition to a small number of anchoring devices permanently attached to the soccer goal frame in places that minimize player contact but which are easily accessible to those installing or removing the net. Eight anchoring sites are typically used, with four of the anchoring sites being in elevated positions near the top of the soccer goal frame, and the remaining four in positions near to the frame's front and back lower corners. Non-stretchable cords or cables are used where the soccer net is to be permanently attached to a soccer goal frame, while stretchable cords are used where the soccer net remains readily detachable. The support cords stiffen the net to allow for easier handling and enhanced installation speed, as well as rapid net separation from the soccer goal frame, particularly where the net is intended to be readily detachable between uses for off-site storage to protect it from theft, vandalism, and premature deterioration due to weathering elements. The support cords can be woven through holes in the net, or bound to the soccer net with filament.

17 Claims, 6 Drawing Sheets

SYSTEM AND METHOD FOR SOCCER NET INSTALLATION

BACKGROUND

1. Field of Invention

This invention relates to soccer goal frames and nets, specifically to a strong, durable, easy to install and use, and relatively low in cost soccer net installation system, and a method for its use, that allows soccer nets to be rapidly installed and removed from soccer goal frames. Some embodiments of the present invention are used for permanent installation of a net to a soccer goal frame, while others are used for detachable connection therebetween and subsequent off-site storage to protect the soccer net from theft, vandalism, and premature deterioration due to weathering elements when not in use. The present invention can be cost effectively incorporated into new soccer goal frames during manufacture, as well as easily retrofitted to existing soccer goal frames. The system and method comprise the use of one or more cords or cables attached to the top and side edges of the soccer net, a means for attaching the soccer net to each cord or cable, and a small number of cord or cable anchoring devices attached in recessed positions on the soccer goal frame that are remote from player contact during game play but which remain easily accessible to those installing or removing the net. Eight anchoring sites are used in the most preferred embodiments of the present invention, with four of the anchoring sites being in spaced-apart positions near to or on the top surfaces of the soccer goal frame and the remaining four anchoring sites being in positions within or near to its front and back lower corners.

2. Description of Prior Art

Soccer is popular sport worldwide and continues to enjoy increasing popularity in the United States. As a result, more soccer goal frames are appearing on school playgrounds and in recreational parks for youth and adult use. Being twenty-four feet across and eight feet high with rearwardly extending lateral support members, regulation soccer goal frames are substantial in size and commonly left on playing fields after use. In contrast, soccer nets are often removed from public places after use due to the hazards of theft, vandalism, and premature deterioration caused by weathering elements. As a result, before use of the present invention, those responsible for preparing soccer fields for play, particularly where more than one opposed pair of soccer goal frames were located, generally found themselves with a high labor cost for installation and removal of nets, or high expenses relating to stolen, damaged, and/or prematurely deteriorated nets.

Since for most effective use they must span the twenty-four foot overhead crossbar, the eight feet high vertically extending front posts, as well as the rearwardly extending parts of the soccer frame, regulation size soccer nets are large and not easily manipulated. Further, installing and removing soccer nets with most prior art systems involves expensive hardware, or a time consuming and cumbersome process. For example, one prior art method of soccer net attachment involves the individual connection of small flat, essentially U-shaped spring clips to the rear surface of the overhead crossbar and the rear surface of the vertically extending front posts of a soccer goal frame. Since soccer nets are flexible, without a means for stiffening the top and side edges of the soccer net or in the alternative very close spacing of the spring clips, the net will not be maintained sufficiently close to the soccer goal frame for optimal wear and use. When using close spacing of spring clips as a means of soccer net attachment to the rear surfaces of the overhead crossbar and the vertically extending front posts, for optimum net attachment the spring clips would need to be placed no further apart than twelve to fourteen inches. At a minimum this would require approximately twenty-two spring clips attached to the overhead crossbar and approximately seven spring clips attached to each front post, resulting in a total of at least thirty-six net attachment points on each soccer goal frame. Assuming for example that a time period of five to ten seconds would be required for net manipulation at each of the attachment points, a minimum time period of approximately five to ten minutes would be required for the attachment of the top and side edges of the soccer net to the overhead crossbar and front posts of one soccer goal frame. Additional time would also be needed for attachment of a second net to the overhead crossbar and front posts of an opposing soccer goal frame, as well as to initially lay out and orient each of the soccer nets prior to attachment, spread each of the nets over the rearwardly extending components of the frame, and for the repeated repositioning of a chair or step-stool upon which a person installing the nets could stand, when needed, to easily reach the spring clips attached to the two overhead crossbars and the upper portions of the front posts. If the actual installment and release time of the net to the overhead crossbar and front posts for each installed net could be reduced from ten minutes to only one or two minutes, the time savings would be significant. Installment and release times under two minutes can be achieved with the detachable preferred embodiments of the present invention. In addition to the disadvantages of cumbersome handling and the substantial amount of time needed to use a soccer net attachment system with thirty-six or more spring clips, the spring clips can become broken during the net installation and removal processes, or as a result of vandalism. Therefore, attachment means supplemental to the spring clips are often needed for effective net installation with prior art systems, such as the use of hook-and-loop types of fasteners which are not inexpensive, strips of duct tape which can become sticky in warm weather and difficult to remove, or small plastic clips or ties which can become easily broken or misplaced. The present invention would require no such supplemental attachment means.

In contrast, to facilitate and enhance the speed of both installation and removal of the soccer net from a soccer goal frame, the present invention uses support cords or cables to stiffen the top and side edges of a soccer net, a means for attaching the cords or cables to the net, and a small number of cord anchoring devices attached to the soccer goal frame in selected recessed positions that are remote from player contact during game play. A first preferred embodiment of the present invention, intended for permanent installation of a soccer net during its useful life, comprises a single substantially non-stretchable support cord or cable. It also comprises a quantity of flexible filamentous material for use in binding the soccer net edges to the cord or cable, in addition to eight anchoring devices each having a central aperture and attached to the soccer goal frame at different attachment sites, with four in elevated positions near to the overhear crossbar and the rear surface of the front posts and four in lowered positions near to the bottom of the soccer goal frame. A second preferred embodiment for detachable net connection comprises three at least slightly stretchable soccer net support cords and eight anchoring sites. As the means for connecting each cord to the net in the second preferred embodiment, the stretchable cords are woven through the soccer net holes, in place of filament attachment. Anchoring devices would include L-shaped brackets, upright posts, hooks, cable clips, and holes or cavities formed into the lower supports. A third preferred embodiment for detachable net connection comprises five at least slightly stretchable soccer net support cords and eight anchoring sites. The cords are also woven through the holes in the soccer net in place of filament attachment. Anchoring devices would include L-shaped brackets, upright posts, rings, hooks, cable clips, and holes or cavities formed into the lower supports. It is also considered within the scope of the present invention to have other permanent and detachable embodiments with varying numbers of cords, as well as a mix of anchoring devices different from that disclosed in the three above-described preferred embodiments.

The prior art believed to be most closely related to the present invention is the net installation system disclosed in U.S. Pat. No. 5,476,266 to Caruso (1995). Although the Caruso invention discloses L-shaped hooks for connecting a soccer net to the overhead crossbar of a soccer goal frame, the L-shaped Caruso hooks have two substantially parallel anchoring legs which are configured for insertion within a channel in the rear surface of the overhead crossbar. The Caruso invention also contemplates the use of a tool in the form of a yoke to stretch the top edge of the net over the hooks attached to the overhead crossbar. In contrast, the present invention is simpler in design, has fewer components, and is more easily retrofitted to existing soccer goal frames. As a result, the present invention would be more cost effective to manufacture and use than the Caruso invention. Further, the L-shaped hooks of the present invention each have only one leg positioned perpendicular thereto, a fundamental difference in structure. The object of the present invention is to stiffen the top and side edges of the net in a way that requires a minimum number of net attachment points to a soccer goal frame and for those attachment points to be in recessed positions that are remote to player contact during game play, such as the front and rear comers between frame components. The Caruso invention uses many net attachment points along the overhead crossbar, as well as along the front posts. Even though the hooks and clips of the Caruso invention may slide easily within the channels during installation or removal of a soccer net, the time required to separate a net from a soccer goal using the Caruso invention would be significantly longer than releasing a soccer net by using the few corner and overhead anchoring devices of the present invention. It is not known to have apparatus and a method for attaching a net to a soccer goal frame with all of the advantages provided by the present invention.

SUMMARY OF INVENTION

Objects and Advantages

The primary object of this invention is to provide a strong, durable, non-complex, easy to use and install, time-saving, and relatively low in cost system and method for attaching a soccer net to a soccer goal frame. A further object of this invention is to provide at least one detachable embodiment that allows for both rapid removal of a soccer net from a soccer goal frame, as well as rapid installation, for use in locations where frequent net removal is desired to avoid the hazards of theft, vandalism, or harsh weathering elements. It is a further object of this invention to provide a soccer net installation system and method which allows close positioning of the soccer net to the soccer goal frame without sagging or gaps for effective use and uniform wear of the soccer net during its useful life. It is also an object of this invention to provide a soccer net installation system that does not require the handling of small, easily lost or broken parts, or special tools. A further object of this invention is to provide a soccer net installation system that can be easily and efficiently incorporated into new soccer goal frames during manufacture, while also offering uncomplicated, minimally labor intensive, and relatively inexpensive retrofitting to existing soccer goal frames.

As described herein, properly manufactured and used, the present invention would provide a system and method for installation of a soccer net to a soccer goal frame that comprises use of one or more support cords connected to the top and side edges of a soccer net to stiffen them, a means for attaching the cord or cords to the soccer net, as well as a small number of anchoring devices that secure the cord or cords to the frame. In the most preferred embodiments four anchoring sites are located in raised positions on or near to the rear surface of the overhead crossbar, and four anchoring sites are located in lowered positions within or near to the bottom of the soccer goal frame, all anchoring sites being in remote, out-of-the-way positions that minimize player contact and injury. The type of attachment used, as well as the small number of attachment sites and their relative positioning, secure the support cord or cords to the soccer goal frame in a manner that facilitates both installation and removal of the soccer net from the frame, even in embodiments where the net is permanently attached to the frame and left in place between uses. A first preferred embodiment of the present invention permanently attaches a soccer net during its useful life to a soccer goal frame by using one substantially non-stretchable support cord or cable with the side and top edges of the soccer net bound to the support cord or cable with a quantity of twine, lightweight rope or chain, corrosion-resistant wire, or other strong, durable, and weather-resistant elongated flexible filamentous material. Eight similarly configured anchoring devices are also used to connect the cord or cable to the frame, each anchoring device having a central aperture. Two of the anchoring devices are secured in the front lower corners of the soccer goal frame, each between one of the horizontal rearwardly extending lower supports and its adjacent front post. Two additional anchoring devices are secured within the rear lower frame comers, each between one of the lower supports and its adjacent obliquely angled rear support. Two anchoring devices are also attached to the rear surface of the overhead crossbar, in centered positions spaced-apart from one another and spaced-apart from the front posts, with the last two anchoring devices each being attached to the top surface of a different one of the rearwardly extending upper supports. To connect a soccer net to a soccer goal frame using the first preferred embodiment, an installer would first attach one end of the cord or cable to the anchoring device in one of the rear lower comers between one of the lower supports and its adjacent oblique support. The end would first be threaded through the central aperture of the comer anchoring device, then doubled back upon itself and secured with a common cable clip or alternative fastening device that is not easily removed so as to help discourage soccer net theft. The opposite end of the cord or cable would then be consecutively threaded through the central apertures in the remaining anchoring devices, starting with the anchoring device in the front lower corner between the original lower support and its adjoining front post, followed by the anchoring device attached to the upper surface of the adjoining upper support, the two anchoring devices attached to the rear surface of the overhead crossbar, the anchoring device attached to the upper surface of the distant upper support, the anchoring device in the front lower comer between the distant front post and its adjoining lower support, and finally the central aperture in the anchoring device in the rear lower corner between the distant lower support and its adjoining oblique support. The cord or cable would then be pulled taut, with the second end of the cord or cable being doubled back upon itself and subsequently secured with a cable clip or alternative not-easily-released fastening device. The net would be placed into its usable position over the two upper supports with the top edge of the net in close proximity to the cord or cable extending along the rear surface of the overhead crossbar. The top edge of the net would then be bound to the portion of the cord or cable adjacent to the overhead crossbar with filament by wrapping the filamentous material through the holes in the soccer net perimeter and simultaneously around the adjacent portion of the cord or cable. Thereafter, the vertically extending and lower side edges of the net would be similarly attached with filament to the cord or cable. No attachment of the rear edge of the soccer net to the rear lower crossbar is contemplated in the first preferred embodiment. Although only one cord or cable is used in the first preferred embodiment, it is considered within the scope of the present invention to have other embodiments that permanently install a soccer net onto a soccer goal frame and which comprise more than one cable or cord, such as an embodiment is having three cords or cables with the longest cord or cable extending along the rear surfaces of both front posts and the overhead crossbar, and two shorter cords or cables each extending along a different one of the lower supports; an embodiment having three cords or cables that would include one cord or cable extending along the overhead crossbar and one of the front posts, one cord or cable extending along the other front post and one of the lower supports, and a short cord or cable extending along the remaining lower support; an embodiment having two cords or cables that would include one cord or cable extending along the overhead crossbar, one of the front posts, and one of the lower supports, as well as a second cord or cable extending along the other front post and one of the lower supports; or an embodiment having five cords or cables that would include one cord or cable extending horizontally along the overhead crossbar, two extending vertically along the two front posts, and two extending horizontally along the two rearwardly extending lower supports.

In addition to the first preferred embodiment disclosed above, two detachable preferred embodiments are also contemplated by the present invention. These second and third preferred embodiments would allow readily detachable connection of a net to a soccer goal frame, so that the net can be stored off-site to protect it from theft, vandalism, and deterioration from weathering elements. Both the second and third embodiments would have eight anchoring sites, however, the second preferred embodiment would comprise three soccer net support cords, with the third preferred embodiment comprising five such cords. Since the cords in both the second and third embodiments are woven through the holes in the soccer net, filament could be used, but would not be required. Anchoring devices at some of the sites would be permanently attached to the soccer goal frame, with anchoring devices also attached to the ends of the cords. The anchoring devices permanently attached to the soccer goal frame in both the second and third preferred embodiments would include two L-shaped brackets and two vertically extending upright posts. The anchoring devices attached directly to the cords would include hooks, as well as cable clips or other similarly functioning fastening device that could secure the end of each cord to a hook. Additionally, the third preferred embodiment would comprise two rings. Also, it is contemplated in both the second and third embodiments for holes to be made in the frame members for permanent attachment of the L-shaped brackets and small upright posts, as well as temporary connection of the hooks during game use. The soccer net support cords in both the second and third embodiments would have at least a minimal amount of elasticity, either being made from a stretchable material, such as that used for bungee cords, or made so that only a small portion of its length incorporates stretchable material. The cords in the second preferred embodiment would comprise a hook on each of its ends, while the top and side cords in the third preferred embodiment would be connected to the small upright posts on the upper supports with a ring.

The top cord of the second preferred embodiment would extend along the rear surfaces of the overhead crossbar and the two front posts. The remaining two cords would extend along the outside surfaces of the two lower supports. To detachably connect a net to a soccer goal frame using the second preferred embodiment, an installer would first weave each stretchable cord through alternate holes in the corresponding edge or edges of the soccer net that it is intended to support. The soccer net would then be placed over the rearwardly extending upper supports of the soccer goal frame. The central portion of the top cord would be placed upon the horizontally extending portion of the two L-shaped brackets attached to the rear surface of the overhead crossbar, and the portion of the top cord adjacent to the upper rear surface of each front post would be placed between the upper rear surface and the adjoining small upright post. The ends of the top cord would then be attached to the opposing lower supports by placing the hook on each of its ends into the front hole or cavity in the outside surface of a different one of the lower supports. If not pre-strung, the two lower cords would then each be woven through holes in a different one of the opposed lower side edges of the soccer net. The hooks on the lower cords would then be inserted into the front and rear holes or cavities in the outside surface of the adjacent lower support, the lower cord front hooks each sharing a hole or cavity with one of the top cord hooks. Detachment of a soccer net connected to a soccer goal frame with the second preferred embodiment would be simple and involve release of the top cord from the L-shaped brackets, and release of the six hooks from the holes or cavities in the lower supports, after which the soccer net would be free from the soccer goal frame and ready for removal. Although three stretchable cords are used in the second preferred embodiment, it is considered within the scope of the present invention to have other embodiments that detachably install a soccer net onto a soccer goal frame, such as an embodiment having only one long cord with hooks on each of its ends, a hole in the rear outside surface of each of the lower supports adapted for attachment of one of the hooks, and an anchoring device to secure the cord near each of the front lower corners of the soccer goal frame, such as an L-shaped, J-shaped, or U-shaped bracket, a small post, or an anchoring device with a central aperture similar to that used in the first preferred embodiment.

In the third embodiment, the top cord intended for horizontal positioning along the rear surface of the overhead crossbar would be the longest of the five cords. The ends of the top cord, as well as one of the ends of each side cord, would be connected to the small upright posts with a ring. A single ring or two separate rings could be used for each paired top and side cord. The other end of each side cord, as well as both ends of each lower cord, would have an attached hook. The cords can be made from stretchable material, or made so that only a small portion of its length incorporates stretchable material. For new installations, soccer nets could be sold pre-strung with support cords. However, for retrofitting the present invention to an existing soccer net, the cords in the third embodiment would be attached to the soccer net immediately prior to extension of the net over the soccer goal frame. Although the anchoring devices attached to the support cords in the third preferred embodiment would help to distinguish the top, side, and lower cords from one another, it is contemplated for the different cords in the third preferred embodiment to optionally be further distinguished from one another by color or surface design to help an installer rapidly select the corresponding cord for each soccer net edge. To detachably connect a net to a soccer goal frame using the third preferred embodiment, an installer would first weave each stretchable cord through alternate holes in the corresponding edge of the soccer net that it is intended to support. The soccer net would then be extended over the rearwardly extending upper supports of the soccer goal frame whereafter the rings would each be placed over a different one of the small upright posts located on the upper supports. The central portion of the top cord would then be placed across the horizontally extending portion of the two L-shaped brackets attached to the overhead crossbar. A hook on the lower end of each side cord would then be made to engage a front hole or cavity formed into the outside surface of the front end of a different one of the lower supports. The remaining two lower cords, if not pre-strung, would then each be woven through holes in a different one of the opposed lower side edges of the soccer net. The hooks on their ends would then be inserted into the opposing front and rear holes or cavities formed in the outside surface of the adjacent lower support, with the front hook of the lower cords sharing a hole or cavity with the lower hook of one of the side cords. Each lower cord becomes stretched taut in a horizontal position against the outside surface of one of the lower supports to hold the lower side edge of the soccer net closely thereto during soccer game use. Removal of a soccer net connected to a soccer goal frame with the third preferred embodiment would be simple and involve release of the top cord from the L-shaped brackets, removal of the rings from the upright posts, and release of the six hooks from the holes or cavities in the lower supports, after which the soccer net would no longer be attached to the soccer goal frame and could be readily pulled away from the overhead crossbar and down from the upper supports. The anchoring devices are all in positions that would not entangle or otherwise impede rapid removal of the net from the soccer goal frame.

Although five stretchable cords are used in the third preferred embodiment, it is considered within the scope of the present invention to have other embodiments that detachably install a soccer net onto a soccer goal frame and which comprise less than five stretchable cords, such as an embodiment having two cords with one long cord having a hook on each of its ends extending along the overhead crossbar, one front post, and one lower support of the soccer goal frame, with a shorter cord extending along the other front post and the other lower support. Further, it is considered within the scope of the present invention to have other embodiments in which the support cords are attached to the soccer goal frame solely through use of hooks and holes or cavities in the frame; or in which the support cords are attached to the soccer goal frame solely through use of rings, fasteners, and upright posts. Also, although in the third preferred embodiment it is contemplated for the rings used for net connection to the upright posts to be rigid, it is considered within the scope of the present invention to have other embodiments in which the rings are made from a flexible material. All of the embodiments of the present invention allow a soccer net to be rapidly installed, and, particularly for the detachable embodiments, to be easily and rapidly removed from the soccer goal frame without the use of small, easily lost or broken components or special installation and/or removal tools, other than a possible chair or stepladder that might be used by people small in stature to enable them to reach the L-shaped brackets and the small upright posts on the eight feet high overhead crossbar and the upper supports, respectively. In most of the preferred embodiments of the present invention, the person installing or removing the net would manipulate a maximum of ten attachment points, eight if only one ring is used between adjacent top and side cords. As a result, when a chair or stepladder is required, the small number of raised attachment points used by the present invention would save time by requiring less chair and stepladder repositioning during net installation and removal than with prior art devices. Also, as compared to the soccer net attachment systems using a plurality of closely-spaced permanently attached spring clips or the Caruso invention, the present invention would require less labor cost for retrofitting to existing soccer goal frames since no channels would need to be formed within the rear surfaces of the overhead crossbar and the front posts, and three dozen or more holes would not need to be marked and drilled into the soccer goal frame for the attachment of the closely-spaced net-holding clips.

The description herein provides the preferred embodiments of the present invention but should not be construed as limiting the scope of the present soccer net installation system or method. For example, variations in the material from which the anchoring devices and support cords are made; the number of support cords used; whether the support cords are made in whole or in part from stretchable or non-stretchable materials; the manner in which the anchoring devices are attached, connected, fit into holes, welded, adhered, or bonded to the soccer goal frame; and the number, type, and spaced-apart distances between anchoring devices connected to the overhead crossbar, other than those shown and described herein, may be incorporated into the present invention. Thus the scope of the present invention should be determined by the appended claims and their legal equivalents, rather than limited to the examples given.

DETAILED DESCRIPTION OF PREFERRED EMBODIMENTS

The present invention comprises many alternative embodiments for a system and method used for installation of a net to a soccer goal frame. All of the embodiments comprise one or more cords or cables for stiffening the upper and side edges of the soccer net. As a result of their design, the preferred embodiments can be easily incorporated during manufacture into new soccer goal frames, as well as easily retrofitted to soccer goal frames already in use. Some embodiments result in permanent attachment of a soccer net to a soccer goal frame during the soccer net's useful life, while other preferred embodiments detachably secure a soccer net to the soccer goal frame for rapid net installation and removal so that it can be stored off-site to protect it from theft, vandalism, and premature deterioration from weathering elements. All preferred embodiments also have a small number of attachment points between the net and the soccer goal frame, usually eight. When eight attachment points are used, two attachment points would be located in spaced-apart positions from one another on the back surface of the overhead crossbar of the soccer goal frame, with one attachment point located on or adjacent to the top surface of each of the horizontal rearwardly extending upper supports, hereinafter referred to as the upper supports. In addition, the remaining four attachment points would be located in close proximity to the opposing ends of the two horizontal rearwardly extending lower supports, hereinafter referred to as the lower supports. Also in the ensuing description, the vertically extending front posts of the soccer goal frame will be referred to as front posts, and the obliquely angled rear supports will be referred to as oblique supports.

Figure 1:
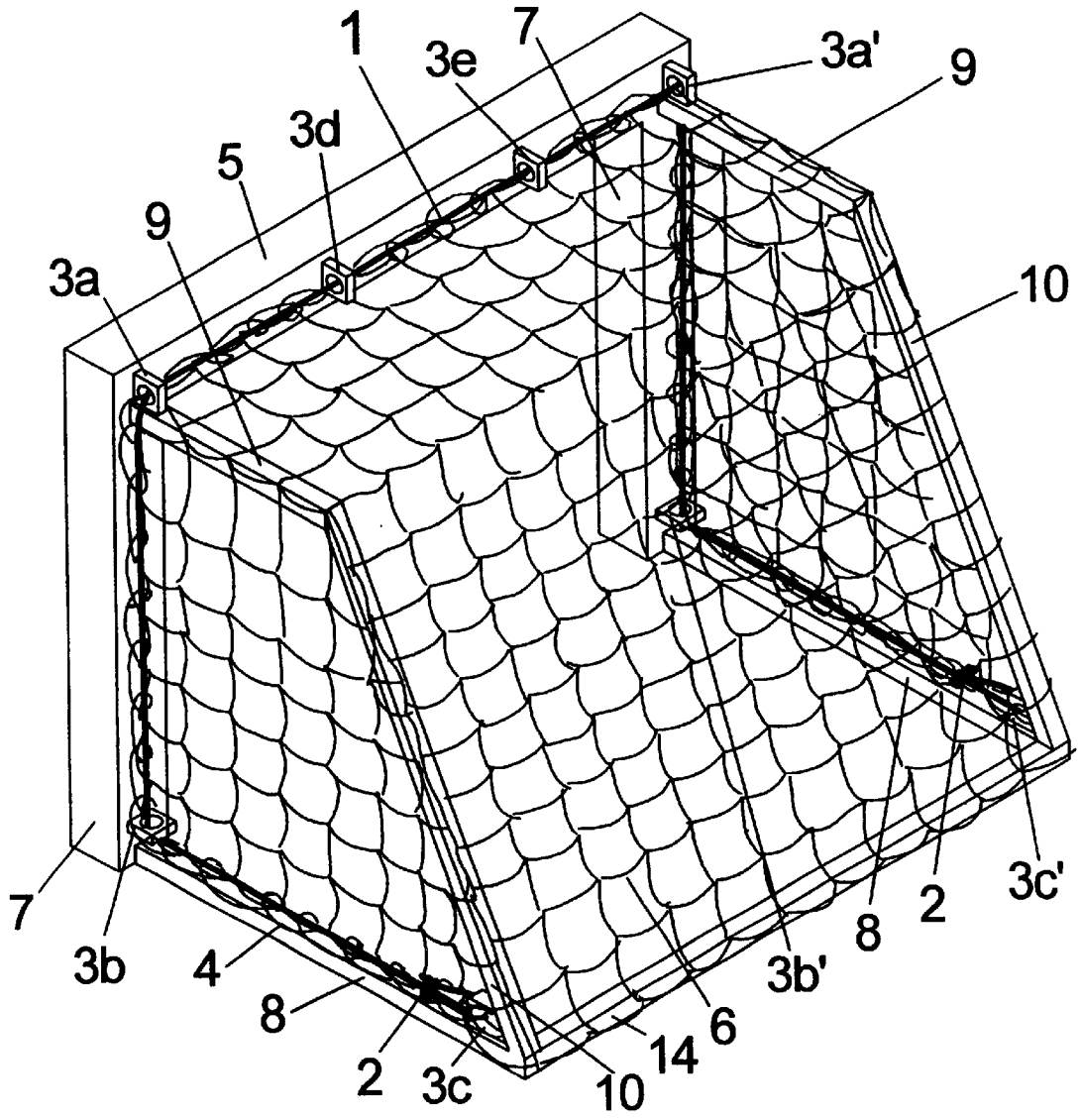
FIG. 1 is a perspective view of a soccer net permanently installed on a soccer goal frame with a first preferred embodiment of the present invention, in which a single net supporting cord or cable is used with eight anchoring devices, wherein the cord or cable is attached to the perimeter of the net on one of its sides with filamentous material, and wherein two of the anchoring devices are secured to the central rear surface of the overhead crossbar, one anchoring device is secured to the rear upper surface of each front post and also to the top surface of the adjoining upper support, one anchoring device is secured to the lower rear surface of each front post, and one anchoring device is secured between each lower support and its adjacent oblique support.

FIG. 1 shows a soccer net 6 permanently installed on a soccer goal frame using a first embodiment of the present invention, with the soccer goal frame comprising two front posts 7; an overhead crossbar 5 connected between the top ends of the two front posts 7; two oblique supports 10 each positioned in line with and rearward from one of the two front posts 7; a lower rear crossbar 14 connected between the bottom ends of the two oblique supports 10; two lower supports 8 each connected between the bottom end of one of the front posts 7 and the bottom end of the adjacent oblique support 10; and two upper supports 9 each connected between the top end of one of the front posts 7 and the top end of the adjacent oblique support 10. Three cord-holding brackets are permanently attached on each side of the soccer goal frame, identified by the numbers 3*a*, 3*b*, and 3*c* on one side and the numbers 3*a*', 3*b*', and 3*c*' on the other side, with 3*a* and 3*a*' each being positioned on the upper surface of a different one of the upper supports 9, 3*b* and 3*b*' each being positioned in the respective corners between one of the front posts 7 and the adjoining lower support 8, and 3*c* and 3*c*' each being positioned between one of the lower supports 8 and the adjacent oblique support 10. Cord-holding bracket 3*b* is shown in more detail in FIG. 2, while cord-holding bracket 3*c* is shown in more detail in FIG. 3. Although FIG. 1 shows cord-holding brackets 3*a* and 3*a*' each attached to the rear surface of the front posts 7, it is equally contemplated for cord-holding brackets 3*a* and 3*a*' to be alternatively attached to the top surface of a different one of the upper supports 9, or to both an upper support 9 and the adjoining front post 7. Similarly, cord-holding brackets 3*b* and 3*b*' could each attached to the lower rear surface of a different one of the front posts 7, the top surface of a different one of the lower supports 8, or both, and cord-holding brackets 3*c* and 3*c*' could be alternatively attached to a different one of the oblique supports 10, the upper surface of a different one of the lower supports 8, or both. Two additional cord-holding brackets 3*d* and 3*e* are shown in FIG. 1 permanently attached to the rear surface of overhead crossbar 5. The number of cord-holding brackets 3 used in the present invention is not critical and additional cord-holding brackets (not shown) could be attached to the rear surfaces of overhead crossbar 5 or front posts 7 depending upon a need determined by the type of material used for cord 1, however the first preferred embodiment uses eight cord-holding brackets 3 and it is contemplated for the number of cord-holding brackets 3 used in all embodiments to be kept at a minimum to reduce unnecessary labor cost during installation and removal of soccer net 6 from a soccer goal frame. Therefore, for most purposes, it is contemplated that two cord-holding brackets 3 attached to overhead crossbar 5 would be sufficient to properly secure soccer net 6 during use. Also, in the first preferred embodiment it is contemplated for cord-holding brackets 3 to be attached to a soccer goal frame by any means that would securely hold them in place, such as but not limited to the use of rivets, screws, welding, adhesives, bonding materials, or a combination thereof.

FIG. 1 also shows the first embodiment of the present invention comprising one cord 1 extending through the central openings in all eight of the illustrated cord-holding brackets 3. The central openings are more easily seen in FIGS. 2 and 3 wherein each is identified by the number 17. Although not shown, it is contemplated for the edges of cord-holding brackets 3 around central openings 17 would be smooth to reduce wear of cord 1. In the first preferred embodiment support cord 1 would be a rigid cable with cord-holding brackets 3 and support cord 1 made from durable, corrosion-resistant materials, such as stainless steel. However, although stainless steel or other corrosion resistant materials are preferred, the materials used to construct cord-holding brackets 3 and support cord 1 are not critical to the present invention. During use of the first preferred embodiment to install soccer net 6, cord 1 would be attached and secured to all eight cord-holding brackets 3, followed by the connection of soccer net 6 to cord 1 with filamentous material, such as filament 4 shown in FIGS. 1 and 2. For clarity of illustration, FIG. 1 only shows filament 4 being connected to cord 1 between brackets 3*a*, 3*b*, and 3*c*, whereas during actual use it is contemplated that filament 4 would secure soccer net 6 to the entire length of cord 1 between brackets 3*c* and 3*c*'. Also, the order of the cord-holding brackets 3 through which cord 1 is inserted during installation or removal is not critical. One end of cord 1 could first be inserted through bracket 3*c*, bracket 3*c*', or even one of the overhead brackets 3*d* or 3*e*. The order of connection of cord 1 through brackets 3*c* and 3*c*' is also not critical and would remain a matter of personal preference for each installer. For illustrative purposes, with installation starting arbitrarily at bracket 3*c*, one end of cord 1 would be inserted through the central opening 17 in bracket 3*c*, doubled back upon itself and crimped with a fastener 2 to form a loop. The other end of cord 1 would be successively inserted through the central openings 17 in brackets 3*b*, 3*a*, 3*d*, 3*e*, 3*a*', 3*b*', and 3*c*', after which cord 1 would be doubled back upon itself, pulled taut, and crimped with a fastener 2 to form a second loop. Cord 1 would then be ready for attachment of soccer net 6 thereto with filament 4. In the preferred embodiment fasteners 2 would be metal clips of sufficient length for wrapping around two adjacent sections of cord 1 and made from corrosion-resistant materials, such as stainless steel. However, it is contemplated that the fasteners 2 shown in FIG. 1 could represent any strong, durable, long-lasting means of binding the end of each cord 1 back upon itself to form a loop that is not easily releasable so as to preserve the theft-resistant objective for the first preferred embodiment, when such an objective is important to the user. Also, although not shown, in addition to the loop end fitting shown in first embodiment in FIG. 1, it is contemplated that support cord 1 could also be configured with a variety of end fittings, such as an eye end fitting or a loop with a thimble end fitting.

FIG. 1 also shows the front, vertical, and lower side edges of soccer net 6 at one end of the soccer goal frame bound to cord 1 with an elongated filament 4. In the preferred embodiment, for ease of handling, more than one filament 4 would be used, and it is contemplated that each such filament 4 would be made from flexible, durable, and weather-resistant materials. Also, it is not critical to the present invention whether each filament 4 is comprised of a single strand of material, or multiple strands, as long as the theft-resistant objective is met. Further, the type of material from which filament 4 is made is not critical and it is considered within the scope of the present invention for filament 4 to comprise twine, corrosion-resistant wire, lightweight cable or chain, a weather-resistant line, tie, wrap, or other cord-like fiber or strand that would theft-resistantly secure soccer net 6 and cord 1 to one another, however it is not contemplated for filament 4 to be made from stretchable material. Also, although not critical, in the first preferred embodiment of the present invention filament 4 would be inserted once through each hole in the top and side edges of soccer net 6 and then around cord 1 prior to being inserted through the next adjacent hold in soccer net 6. In the alternative, filament 4 could be inserted twice through each hole of soccer net 6, or through alternating holes in soccer net 6. In the preferred embodiment shown in FIG. 1, soccer net 6 is not attached to lower rear crossbar 14. However, it is considered within the scope of the present invention to have other embodiments in which soccer net 6 is bound to rear crossbar 14 with filament 4, or other means such as plastic ties or hook-and-loop type of fasteners (not shown) to further deter theft of soccer net 6.

Figure 2:
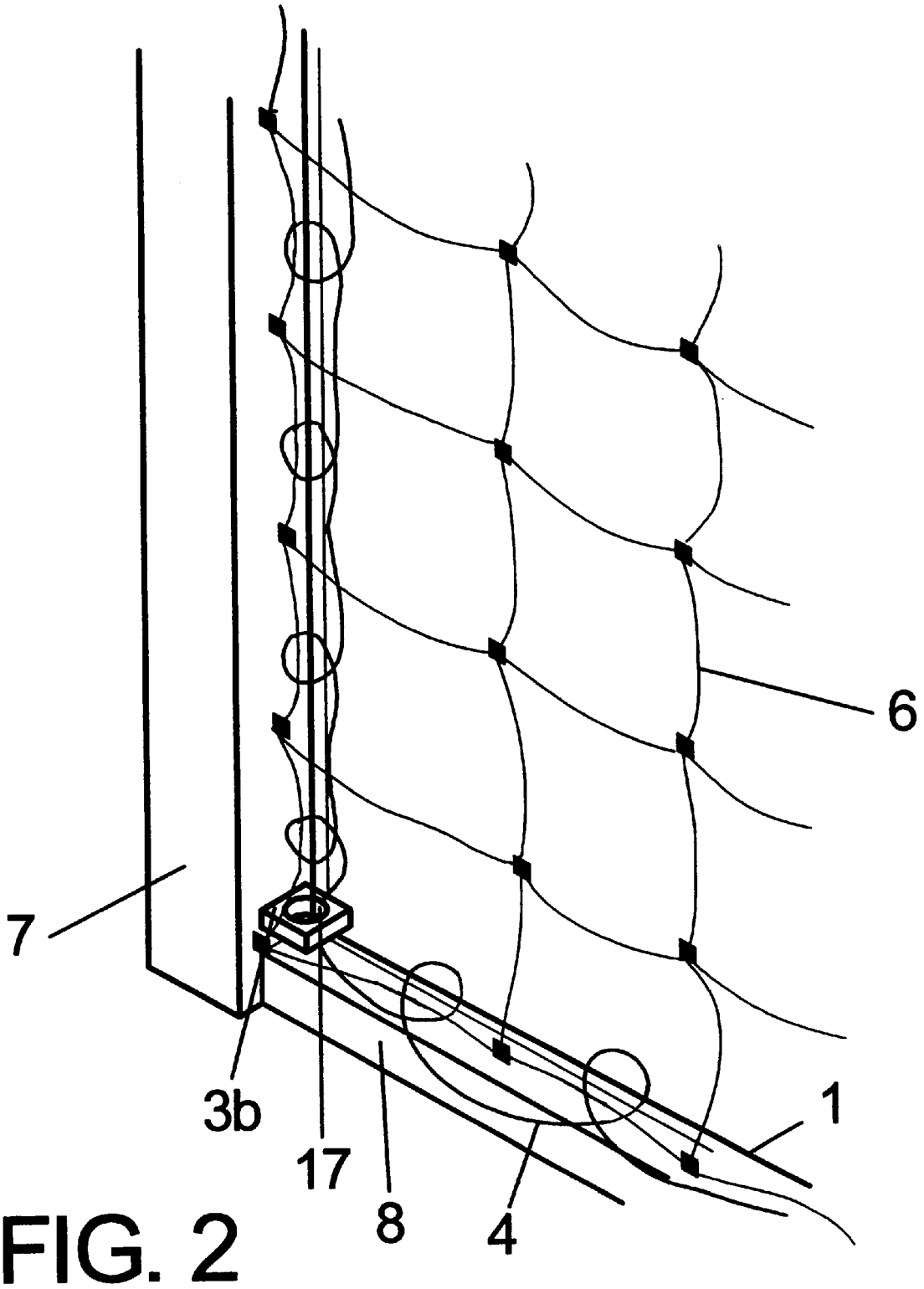
FIG. 2 is an enlarged perspective view of the first preferred embodiment showing a cord-holding anchoring device permanently attached to the lower rear surface of one of the front posts, the net support cord extending through a central hole in the anchoring device, and filamentous material securing the cord to the side and lower edges of the net.

FIG. 2 shows cord-holding bracket 3*b* in the first preferred embodiment positioned in a lower corner of a soccer goal frame between front post 7 and lower support 8. FIG. 2 also shows support cord 1 extending through the central opening 17 in cord-holding bracket 3*b*. While in FIG. 2 one side edge of cord-holding bracket 3*b* is attached to the lower rear surface of front post 7, it is equally contemplated for the bottom edge of cord-holding bracket 3*b* to be attached to the upper surface of lower support 8 close to front post 7. It is contemplated for cord-holding bracket 3*b* to be made from strong, durable, and weather-resistant materials, such as stainless steel, or other materials having a weather-resistant covering or coating. For theft considerations cord-holding bracket 3*b* should be securely and permanently attached to front post 7 or lower support 8 by means that do not allow easy separation of therefrom, such as through the use of rivets, screws, welding, adhesives, bonding materials, or a combination thereof. Although not shown, an alternative embodiment could comprise two cords 1, each inserted through cord-holding bracket 3*b*, doubled back upon itself, and then crimped with a fastener, such as fastener 2 in FIG. 3, to form a loop so that the two cords 1 become positioned at approximately 90° from one another on adjacent sides of central opening 17. Any fastener 2 used would be a strong, durable, weather-resistant, and quickly attached means of binding the end of each cord 1 back upon itself to form a loop, including stainless steel clips that can be instantaneously secured in place with applied pressure. Since soccer nets 6 are large and relatively expensive to replace, theft-resistance should be a consideration in selecting the type of fasteners 2 used and fasteners 2 should also be fast-holding and not easily separated from any cord 1 once set in place. FIG. 2 also shows the vertical and lower side edges of soccer net 6 bound to cord 1 with an elongated filament 4. Although not shown, more than one filament 4 could be used. Further, it is contemplated for the flexible weather-resistant material from which filament 4 is made to comprise twine, corrosion-resistant wire, lightweight cable or chain, a weather-resistant line, tie, wrap, or other cord-like fiber or strand that would durably secure soccer net 6 and cord 1 to one another, although it is not contemplated in the first preferred embodiment for filament 4 to be made from stretchable material. Also as shown in FIG. 2 although not critical, filament 4 in the first preferred embodiment of the present invention would be inserted once through each hole in the top and side edges of soccer net 6 and around the adjacent portion of cord 1 prior to being inserted through the next adjacent hold in soccer net 6, except in the front lower corners of soccer net 6 wherein it is contemplated for filament 4 to be inserted at least once around cord 1 and soccer net 6 on each side of cord-holding bracket 3*b*.

Figure 3:
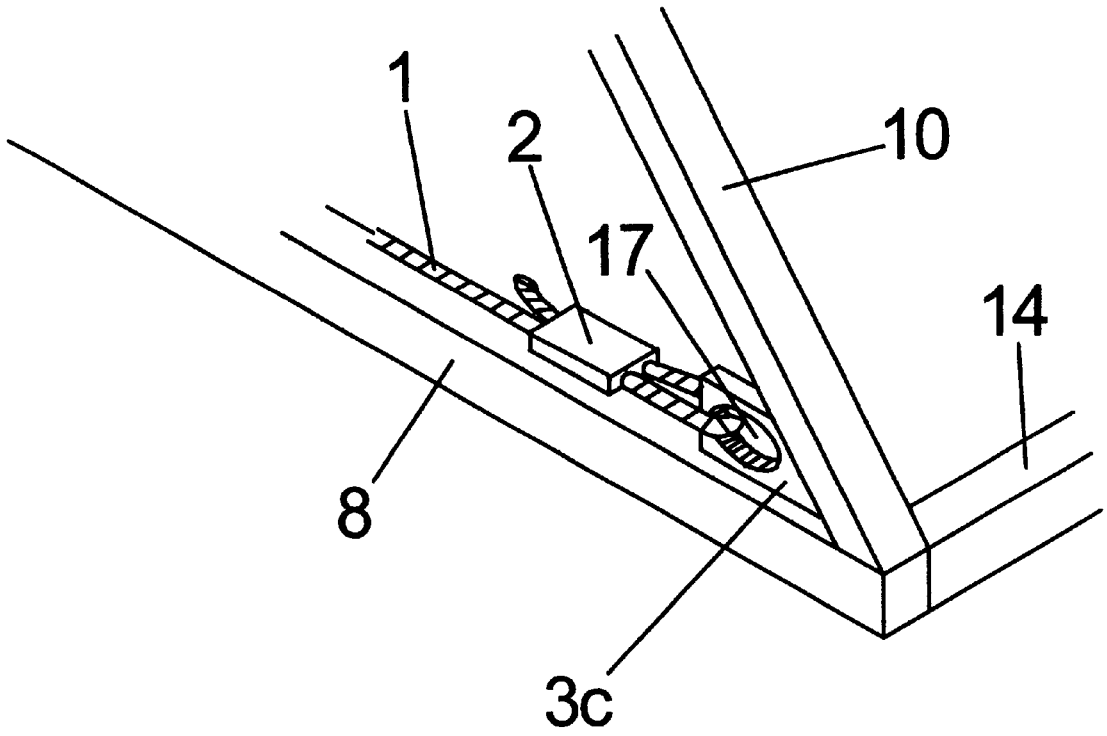
FIG. 3 is an enlarged front view of the first preferred embodiment showing a cord-holding anchoring device permanently attached to a soccer goal frame between one of the oblique supports and the upper rear surface of its adjoining lower support, in addition to a net support cord being inserted through the central hole in the anchoring device, doubled back upon itself, pulled taut, secured with a fastener to form a loop, and thereby made ready for attachment to a soccer net with filament.

FIG. 3 shows one cord-holding bracket 3*c* in the second preferred embodiment of the present invention with a central opening 17 therethrough and being attached in the lower rear comer of a soccer goal frame between lower support 8 and oblique support 10. FIG. 3 also shows support cord 1 in an approximately horizontal position directly above lower support 8, with one of its ends inserted through central opening 17, doubled back upon itself to form a loop, and secured to the remainder of cord 1 with a fastener 2. FIG. 3 further shows cord 1 pulled taut and ready for use in connecting soccer net 6 thereto with filament 4. It is contemplated for cord 1 to be made from durable, weather-resistant materials and should soccer net 6 need replacement for any reason, it is contemplated that cord 1 could remain in place after removal of filament 4 so as to be ready for use in attachment of a replacement soccer net 6. Although in FIG. 3 it is contemplated for cord-holding bracket 3*c* in the first preferred embodiment to be attached to both oblique support 10 and the upper surface of lower support 8, it is equally contemplated for cord-holding bracket 3*c* to be attached to only one or the other and attached by any means that would securely hold it in place, such as but not limited to rivets, screws, welding, adhesives, bonding materials, or a combination thereof.

Figure 4:
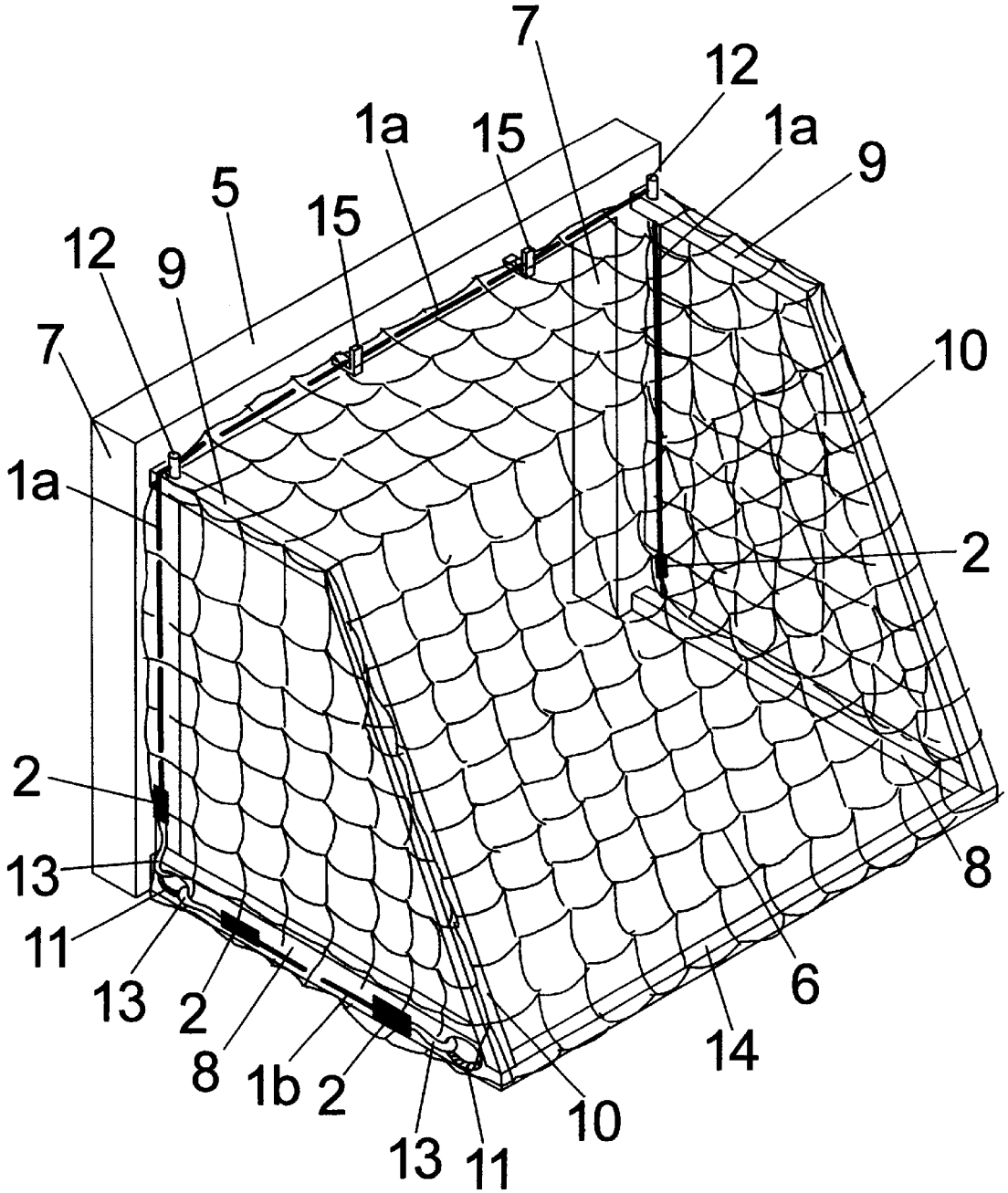
FIG. 4 is a perspective view of a soccer net installed on a soccer goal frame to illustrate a second preferred embodiment of the present invention in which two L-shaped brackets are permanently attached to the rear surface of the overhead crossbar, one small upright post is permanently attached to the top surface of each of the horizontal rearwardly extending upper supports at a spaced-apart distance from the rear surface of the adjacent front post, three support cords are woven through the holes in the top, side, and lower edges of the soccer net with the ends of each cord secured with a fastener to a hook, the hooks detachably secured in holes or cavities formed into the outside surface of the horizontally extending lower supports, and the longest cord being supported by the upper surface of the L-shaped brackets, as well as positioned between each upright post and the rear surface of the adjoining front post.
Figure 5:
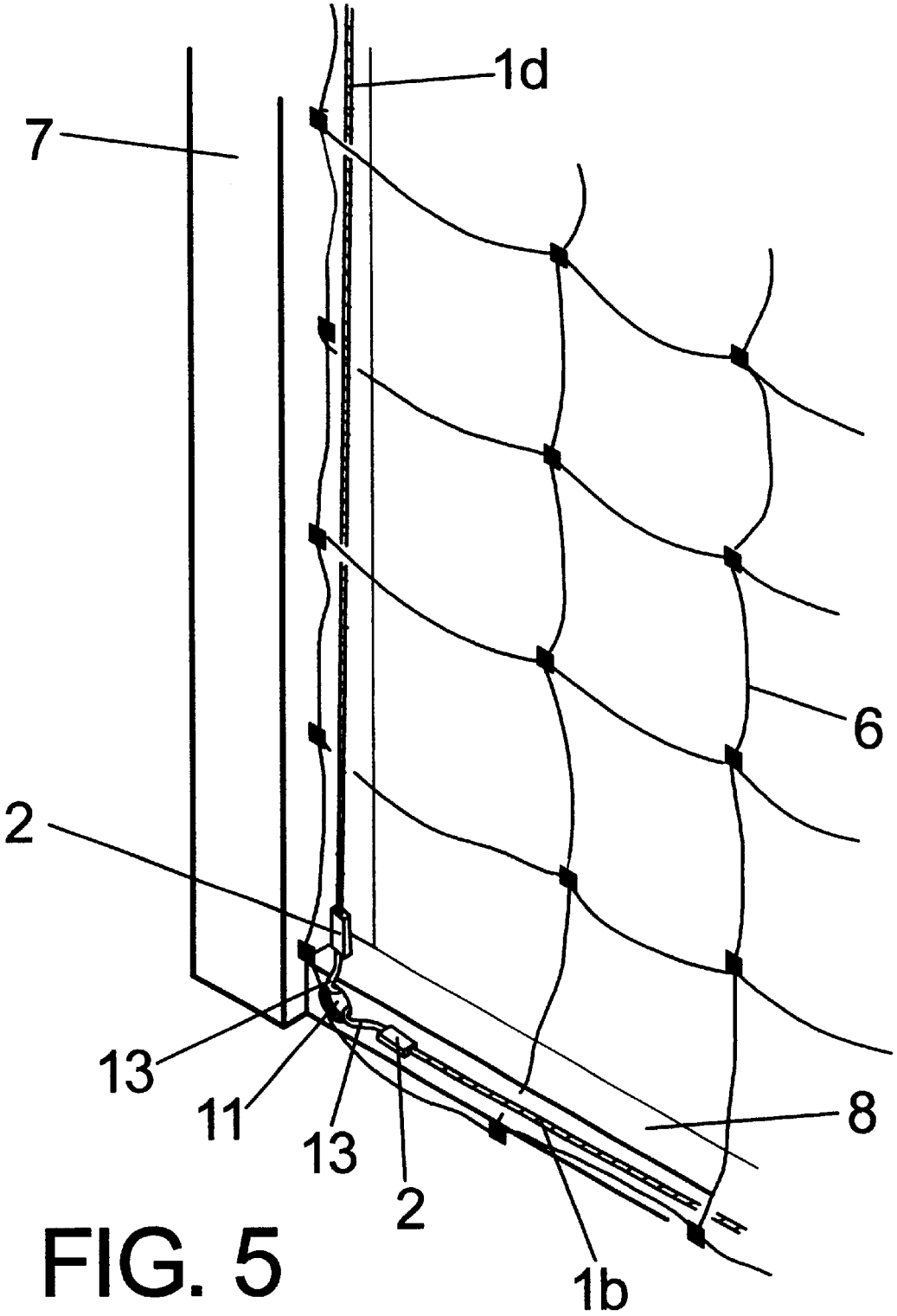
FIG. 5 is an enlarged perspective view of a third preferred embodiment of the present invention connecting a net to a soccer goal frame, with two cords woven through alternate holes in adjacent perimeter edges of the soccer net, the visible end of each cord having a separate hook attached thereto, and the two hooks secured within the same front hole or cavity on the outside surface of a lower support of the frame.

FIG. 4 shows a soccer net 6 detachably installed on a soccer goal frame using a second embodiment of the present invention. The second embodiment could be easily applied to new soccer goal construction, as well as cost-efficiently retrofitted to existing soccer goal frames. The second embodiment of the present invention comprises three stretchable cords, although in FIG. 4 only two are shown, cords 1*a* and 1*b*. Cord 1*a* is the longest, supporting the top and both vertical side edges of soccer net 6. Cord 1*b* supports one of the lower side edges of soccer net 6 along the outside surface of one of the lower supports 8. Although the outside surface of the opposed lower support 8 is not visible in FIG. 4, the second embodiment has a cord comparable in configuration to cord 1*b* that is positioned along the hidden outside surface of the opposed lower support 8 during soccer game use. For discussion purposes the third hidden cord will be referred to as cord 1*c*. In the second embodiment, cords 1*a*, 1*b*, and 1*c* would all comprise stretchable materials, such as bungee cord material, or at least have a segment of stretchable material incorporated therein. Although filament 4 could be used in the second preferred embodiment to attach soccer net 6 to cords 1*a*, 1*b*, and 1*c*, as shown in FIG. 4, it is preferred for cords 1*a*, 1*b*, and 1*c* to be woven through openings near the top and side edges of soccer net 6. The second embodiment also comprises eight attachment points for soccer net 6, two on overhead crossbar 5, one on the forward top surface of each upper support 9, and four on the outside surfaces of the two lower supports 8, with one attachment point being near to the front and back ends of each lower support 8. Although FIG. 4 only shows holes 11 on one lower support 8, it is contemplated for holes 11 to also be formed in the hidden outside surface of the opposed lower support 8, as well as into the soccer goal frame at each of the attachment points where needed to facilitate the connection of hardware needed to hold soccer net 6 in place during use. The depth of holes 11 is not critical, as long as each hole 11 adequately performs its function. In the second preferred embodiment it is contemplated for such hardware to comprise an assortment of hooks 13, fasteners 2, upright posts 12, and L-shaped brackets 15. To attach a soccer net 6 to a soccer goal frame using the second preferred embodiment of the present invention, a hook 13 would be connected to each end of cords 1*a*, 1*b* and 1*c*. Although in FIG. 4 hooks 13 are shown to be attached to cords la and 1*b* through use of a fastener 2, such attachment is not critical and it is contemplated for hooks 13 to be connected to cords 1*a*, 1*b*, and 1*c* in any manner that would allow hooks 13 to remain securely and permanently connected thereto during soccer game use. FIG. 4 shows cords 1*a* and 1*b* woven through adjacent openings in soccer net 6. In the alternative and although used of adjacent openings is preferred, cords 1*a*, 1*b*, and 1*c* could be woven through every third hole in soccer net 6, or for soccer net 6 to be purchased pre-strung with stretchable cords 1*a*, 1*b*, and 1*c*. Although the weaving of cords 1*a*, 1*b*, and 1*c* through soccer net 6 could be performed prior to placement of soccer net 6 over upper supports 9 or thereafter, due to the eight foot height of a regulation sized crossbar 5 it is contemplated that most efficient connection of cords 1*a*, 1*b*, and 1*c* to soccer net 6 would occur prior to placement of soccer net 6 over upper supports 9. Although FIG. 5 shows a third embodiment of the present invention, the connection of hook 13 to the ends of cord 1*d* and 1*b* with fasteners 2, and the weaving of cords 1*b* and 1*d* through adjacent openings in soccer net 6, would be similar to the connection of cords 1*a* and 1*b* in FIG. 4. When pre-strung, the hooks 13 on the ends of cords 1*a*, 1*b*, and 1*c* could each be temporarily fastened to soccer net 6, to maintain cords 1*a*, 1*b*, and 1*c* substantially in their usable woven positions during transport. Once cords 1*a*, 1*b*, and 1*c* are woven through soccer net 6 and soccer net 6 is placed over upper supports 9 and oblique supports 10, the hook 13 on each of end of cords 1*a*, 1*b*, and 1*c* would be placed into the hole 11 closest thereto in lower support 8, whereby due to their stretchable material cords 1*a*, 1*b*, and 1*c* would each be pulled taut. Thereafter, cord 1*a* would be placed between each small upright post 12 and the adjacent front post 7, as well as over the horizontally extending upper surfaces of the two L-shaped brackets 15. Although not shown in FIG. 4, means other than small upright posts 12, such as a bolt with an over-sized head, could be used to maintain cord 1*a* close to the rear surface of the top end of front post 7 during soccer game use.

FIG. 4 shows two L-shaped brackets 15 permanently attached to the rear surface of overhead crossbar 5 with the horizontally and rearwardly extending proximal end of each L-shaped bracket 15 positioned approximately perpendicular to overhead crossbar 5 and its distal end pointing in an upwardly direction. Although two L-shaped brackets 15 are preferred so as to keep the number of attachment points at a minimum to reduce unnecessary labor expense during installation and removal of soccer net 6 from a soccer goal frame, the use and number of L-shaped brackets 15 in the second preferred embodiment of the present invention is not critical. Further, the "L" shape of brackets 15 is not critical and it is also considered within the scope of the present invention for brackets 15 to have a "C" shape, a "J" shape, or other arcuate or partially arcuate configurations. Although the means of attachment for L-shaped brackets 15 to overhead crossbar 5 is not critical, it is preferred that they be riveted, screwed, welded, or secured to a soccer goal frame with bonding agents.

In the second preferred embodiment, support cords 1*a*, 1*b*, and 1*c* would be made from stretchable cords or rigid stainless steel cables with at least one stretchable segment incorporated therein to facilitate release of cords 1*a*, 1*b*, and 1*c* from each of the eight attachment points on a soccer goal frame. In the second preferred embodiment it is also contemplated for upright posts 12 and L-shaped brackets 15 to be made from durable, corrosion-resistant materials, such as stainless steel, or to be coated or covered with weather-resistant materials. However, although stainless steel or other corrosion resistant materials are preferred, the materials used to construct upright posts 12, L-shaped brackets 15, and support cords 1*a*, 1*b*, and 1*c* do not critically affect the design as long as they resist untimely deterioration from weathering elements. In the second preferred embodiment shown in FIG. 4, soccer net 6 is extended over lower rear crossbar 14 but not attached to it. Attachment of soccer net 6 to lower crossbar 14 is not considered essential, however it is considered within the scope of the present invention to have embodiments in which soccer net 6 is bound to rear crossbar 14 in several places with an easily detachable means not likely to cause player injury upon contact (not shown), such as hook-and-loop fasteners or plastic ties.

Figure 6:
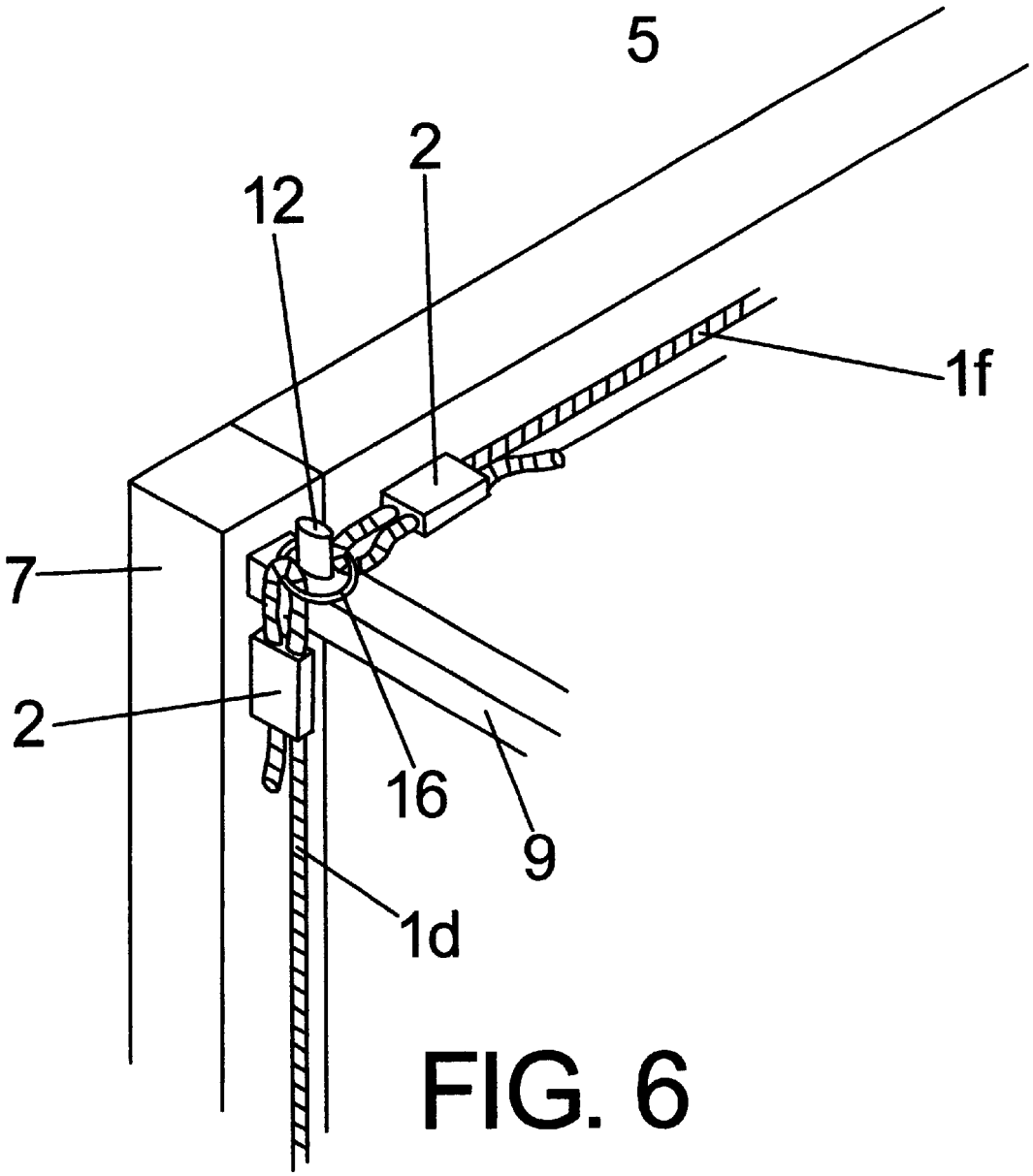
FIG. 6 is an enlarged front view of the third preferred embodiment of the present invention, with the soccer net omitted for clarity of illustration, wherein a small upright post is attached to the top surface of one of the upper supports, a ring is placed over the small upright post, and the ends of two adjacent cords are each inserted through the ring, doubled back upon itself, pulled taut, and secured with a not easily releasable fastener.

FIGS. 5 and 6 show a third embodiment of the present invention respectively with a soccer net 6 detachably connected to one lower support 8 with hooks 13 and connected to one upper support 9 with an upright post 12 and a ring 16. Although not completely shown in FIGS. 5 and 6, it is contemplated for the third embodiment to be similar to the second embodiment in all respects except that the third embodiment would comprise five cords 1 instead of three, and connection of soccer net 6 to the upper supports 9 would comprise a ring 16 connected to upright posts 12. As partially shown in FIG. 4, the second embodiment comprises three cords 1*a*, 1*b*, and 1*e*, with cord 1*a* extending along the rear surface of overhead crossbar 5 and the rear surfaces of both of the front posts 7. However, in the third embodiment as partially shown in FIGS. 5 and 6, cord 1*a* is replaced by three cords, a first cord 1*d* extending along the rear surface of one front post 7, as well as a second shorter top cord 1*f* extending along the rear surface of overhead crossbar 5 and connected to a ring 16. Although not shown in FIGS. 5 and 6, cord 1*a* would also be replaced by a third cord extending along the rear surface of the opposed front post 7, designated as cord 1*e* for discussion purposes and being connected to an upright post 12 on the opposed upper support 9 with a second ring 16. Cord 1*e* would be similar in configuration and means of attachment to cord 1*d*. Therefore, in the third embodiment it is contemplated for both ends of cord if to be connected to first and second rings 16, with one end of cord 1*d* also connected to the first ring 16 and one end of cord 1*e* connected to the second ring 16. The opposing ends of cords 1*d* and 1*e* would each comprise a hook 13. In addition to the three cords 1*d*, 1*e*, and 1*f*, the third embodiment would also comprise a fourth cord 1*b* shown in FIG. 5 and extending along the outside surface of one lower support 8, as well as a fifth cord not shown in FIG. 5 or FIG. 6 but for discussion purposes designated as cord 1*c* which is similar to cord 1*b* and extends along the outside surface of the opposed lower support 8. In the third embodiment cords 1*b* and 1*c* would each have a hook 13 on both of its ends for extending cords 1*b* and 1*c* each along the outside surface of a different one of the lower supports 8 and between two holes 11 located near to the opposing ends of each lower support 8 on its outside surface. Hooks 13 and rings 16 are each configured to allow rapid connection and detachment of soccer net 6 from lower supports 8 and upper supports 9 during installation of soccer net 6 and its removal therefrom for off-site storage, but also to minimize unintentional disconnection. Therefore, holes 11 in the third embodiment must be configured for secure engagement of two hooks 13 without one hook 13 interfering with the function of the other. However, holes 11 in the third embodiment cannot Into be overly large as to allow unintentional disengagement of hooks 13. Also in the third embodiment, it is contemplated for cords 1*b*, 1*c*, 1*d*, 1*e*, and if to all comprise stretchable materials, such as bungee cord material, or for each to have a segment of stretchable material incorporated therein. The stretchable materials used must allow easy manipulation of rings 16 over upright posts 12 and rapid attachment of hooks 13 to holes 11, but also must secure soccer net 6 against overhead crossbar 5 without sagging. Further and although not shown, in the third embodiment the use of upright posts 12 and rings 16 are not critical, and it is contemplated to have other connection means instead of upright posts 12 and rings 16, such as eye-bolts and hooks 13, wherein an eye-bolt is substituted for each upright post 12. The eyebolts would each have a central aperture and would be attached to the top surface of upper support 9 near to the adjoining front post 7. Hooks on the ends of cords 1*f*, 1*e*, and 1*d* could be directly inserted through the central apertures in the eye-bolts, or the ends of cords 1*f*, 1*e*, and 1*d* could be attached to the ring portion of a ring connector having a hook depending therefrom with the depending hook inserted through the central aperture of an eye-bolt. The ends of cords 1*f*, 1*d*, and 1*e* would each be placed through the ring portion of each ring connector and the depending hook inserted through the central aperture of the eye-bolt. Although not shown, another alternative to rings 16 and upright posts 12 would be to have upright posts 12 replaced by bolts having an oversized head. Further, instead of the rigid rings 16 contemplated for the third embodiment, rings 16 could be made from flexible or stretchable material for easy manipulation over the oversized heads of each bolt. Although not critical and not shown in FIGS. 5 and 6, it is also contemplated for the third embodiment to have two L-shaped brackets 15 along overhead crossbar 5, similar to those shown in FIG. 4. In the third embodiment, as in the second embodiment, soccer net 6 is not connected directly to either front post 7, although with the help of cords 1*d* and 1*e* the vertical side edges of soccer net 6 remain in close proximity to the rear surfaces of front posts 7 during game use. FIG. 5 further shows cords 1*d* and 1*b* permanently woven through alternate holes in the perimeter of soccer net 6 and a fastener 2 securing one hook 13 to cord 1*d* and a different fastener 2 securing a second hook 13 to cord 1*b*. In FIG. 6 soccer net 6 is omitted for clarity of illustration, however, FIG. 6 shows a fastener 2 securing one end of cord 1*d* to a ring 16 and a different fastener 2 securing one end of cord if to the same ring 16. Although the type of fastener used is not critical to the present invention, in the third preferred embodiment fasteners 2 would comprise a quickly applied stainless steel clip that is crimped with force around each hook 13 and its adjoining cord 1*d*, 1*b*, 1*c*, 1*e*, or 1*f*. To release a soccer net 6 from a soccer goal frame connected by the third preferred embodiment, the person (not shown) removing soccer net 6 would only have to release the six hooks 13 on cords 1*b*, 1*c*, 1*e* and 1*d* from holes 11, release cord if from L-shaped brackets 15, and release both rings 16 from upright posts 12. Soccer net 6 would then be ready for folding into a compact configuration and transport from the soccer goal frame site. Since it is contemplated for cords 1*b*, 1*c*, 1*d*, 1*e*, and if in the third embodiment to all comprise stretchable material, it is not critical whether the hooks 13 or the rings 16 would be released first. However, releasing the six hooks 13 first could provide a slight advantage in removing the elevated cord 1*f* from rings 16 and L-shaped brackets 15. Unless easily removable by threaded connection, upright posts 12 and L-shaped brackets 15 would remain attached respectively to upper support 9 and overhead crossbar 5 for subsequent soccer net 6 installation. Although the materials from which upright posts 12, fasteners 2, and rings 16 would be made are not critical to the third preferred embodiment, they should be weather-resistant, and in the third preferred embodiment upright posts 12, fasteners 2, and rings 16 would be made from stainless steel. Also, although in the third preferred embodiment cords 1*f*, 1*e*, 1*c*, 1*b*, and 1*d* could be attached to soccer net 6 with filament 4 or woven through every third opening in soccer net 6, it is preferred that cords 1*f*, 1*e*, 1*c*, 1*b*, and 1*d* be woven through alternate openings near the perimeter of soccer net 6.

To install soccer net 6 on a soccer goal frame using the first embodiment of the present invention shown in FIGS. 1–3, if cord-holding brackets 3*a*, 3*b*, 3*c*, 3*a*', 3*b*', and 3*c* had not been installed during manufacture, the person (not shown) installing soccer net 6 would first attach cord-holding brackets 3*a*, 3*b*, 3*c*, 3*a*', 3*b*', and 3*c* with rivets, screws, welding, bonding agents, or a combination thereof, to the designated attachment points of the soccer goal frame on the top surface of each upper support 9, between each front post 7 and the adjacent lower support 8, and between each lower support 8 and the adjacent oblique support 10. Two cord-holding brackets 3*d* and 3*e* would also be centrally attached by similar means to the rear surface of overhead crossbar 5 at a spaced-apart distance from one another. The person installing soccer net 6 would then slip soccer net 6 over both upper supports 9 and let gravity drop soccer net 6 approximately in place. The installer would then pull soccer net 6 approximately into its usable position. Thereafter, cord 1 would be inserted through the central opening 17 in cord-holding bracket 3*c*, and the end of cord 1 would be folded back upon itself and secured with a fastener 2 to form a loop. In the alternative, the person installing soccer net 6 could start with cord-holding bracket 3*c*'. The soccer net 6 installer (not shown) would then thread cord 1 through cord-holding brackets 3*b*, 3*a*, 3*d*, 3*e*, 3*a*', 3*b*', and 3*c*'; or 3*b*', 3*a*', 3*e*, 3*d*, 3*a*, 3*b* and 3*c* if the installer started with cord-holding bracket 3*c*'. The unattached end of cord 1 would then be doubled back on itself and secured with a fastener 2 to form a loop. Thereafter, one or more filaments 4 would be inserted through the holes in the top, vertical, and lower side edges of soccer net 6 and around adjacent portions of cord 1 to bind soccer net 6 securely to cord 1. Therefore, soccer net 6, cord 1, and filament 4 in the first embodiment of the present invention would all extend over the top surface of upper support 9. In an alternative embodiment where three cords, 1*a*, 1*b*, and 1*c*, would be used instead of a single cord 1, preferably after cord 1*a* is secured in place, cord 1*b* would be attached to cord-holding brackets 3*b* and 3*c*, with cord 1*c* attached to cord-holding brackets 3*b*' and 3*c*'. Thereafter, the sides edges of soccer net 6 would be bound to adjacent portions of cords 1*b* and 1*c* for secure positioning of each next to a different one of the lower supports 8. Either cord, 1*b* or 1*c*, could be attached first. One end of cord 1*b* would be inserted through the central opening 17 in either cord-holding bracket 3*b* or 3*c*, doubled back upon itself and secured with a fastener 2 to form a loop. The remaining end of cord 1*b* would be inserted through the central opening 17 in the other cord-holding bracket, either 3*c* or 3*b*, doubled back upon itself, pulled taut, and secured with a fastener 2 to form a loop. Cord 1*c* would then be fastened in a similar manner to cord-holding brackets 3*b*' and 3*c*'. The rear edge of soccer net 6 could optionally be attached to lower rear crossbar 14, when desired, with filament 4, hook-and-loop fasteners, or flexible ties (not shown) that would not injure players coming into contact with them.

To remove a soccer net 6 attached to a soccer goal frame using the first embodiment of the present invention, the person (not shown) removing soccer net 6 would detach filament 4 from net 6 and support cord 1. Thereafter, soccer net 6 could be pulled away from upper supports 9, overhead crossbar 5, and oblique supports 10. Cord 1 could be left in place for the subsequent attachment of the same or a different soccer net 6. Should it be desired to also remove cord 1 from the soccer goal frame, fasteners 2 would need to be removed from both ends of cord 1 so that cord 1 could be slipped out of center holes 17 in all of the eight cord-holding brackets 3*c*, 3*b*, 3*a*, 3*d*, 3*e*, 3*a*' 3*b*', and 3*c*'. Any connection of soccer net 6 to rear lower crossbar 14 would also have to be removed. Filaments 4 could be retained for use in attaching another soccer net 6 to the soccer goal frame, or discarded and replaced by new filament 4.

To install soccer net 6 on a soccer goal frame using the second or third detachable embodiments of the present invention, the installer would first connect stretchable cords 1*a*, 1*b*, and 1*c*, or in the alternative cords 1*b*, 1*c*, 1*d*, 1*e* and 1*f*, to the appropriate edges of soccer net 6 by weaving all cords 1 through adjacent openings in soccer net 6 close to its perimeter. The opposite ends of each cord 1 would be inserted through a different ring 16, doubled back on itself and secured with a fastener 2 to form a loop. The rings 16 would then be each placed over one of several small posts 12 connected in raised and lowered recessed positions on the soccer goal frame that are remote from player contact during game play. In the alternative a hook 13 could be attached to the end of each cord 1 and connected to holes 11 in opposite ends of the outside surface of both lower supports 8, as well as the top surface of upper supports 9. As illustrated in the second preferred embodiment, instead of holes 11 in the top surface of upper supports 9, an upright post 12 could be positioned thereon, to maintain cord 1*a* in a position close to the rear surface of the top end of each front post 7. Prior to being secured with fastener 2 or hook 13, it is contemplated that the end of each cord 1 would be woven through openings close to the perimeter of soccer net 6. Adjacent cords 1, such as cords 1*b* and 1*d*, cords 1*d* and 1*a*, cords 1*a* and 1*e*, and cords 1*e* and 1*c*, would have one of its ends extending through the same ring 16 or eye-bolt (not shown). Once cords 1 were thus attached to soccer net 6, the installer would extend soccer net 6 over both upper supports 9 and both oblique supports 10, and let gravity cause the sides of soccer net 6 to fall toward lower supports 8. Cord 1*a* or If would also be extended over both L-shaped cord-holding brackets 15 to bring the top edge of soccer net 6 adjacent to the rear surface of overhead crossbar 5. If using rings 16 and upright posts 12, the installer would then place each ring 16 over a different upright post 12. Thereafter, the hooks 13 on the second ends of cords 1*d* and 1*e* would be connected to an adjacent hole 11 in lower support 8. Finally, the hooks 13 connected to the second ends of cords 1*b* and 1*c* would also be connected to an adjacent hole 11 in lower support 8. In the alternative, rings 16 could first be connected over the upper flange of an upright post 12 substitute, such as a bolt with an oversized head (not shown), with the final connections made between the rings 16 connected over upright posts 12 or substitute thereof Conversely, when hooked rings and eye-bolts (not shown) are used instead of hooks 13 and rings 16, the hooked portion of the hooked rings secured to cords 1*a*, 1*d*, and 1*e* would first be inserted into the central apertures of the eye-bolts positioned on the top surface of the upper supports 9. The order of connection is not critical. Thereafter, the hooked portions of the hooked rings attached to cords 1*b*, 1*c*, 1*d*, and 1*e* would be inserted into the central apertures in eye-bolts positioned adjacent to the lower supports 8. The lower rear edge of soccer net 6 would then be evenly distributed across bottom crossbar 14, but not attached thereto. If attachment of soccer net 6 to rear lower crossbar 14 were desired, although not shown, several quick-release fasteners, such as hook-and-loop types of fasteners could be used.

To remove soccer net 6 from a soccer goal frame using the second or third embodiments of the present invention, a user would first slip cord 1*a* or if upward and away from the distal end of L-shaped brackets 15. The user would then remove all of the hooks 13 from holes 11 and rings 16 from small upright posts 12. The order of removal is not critical. Thereafter, soccer net 6 would be free from the soccer goal frame and could be easily pulled away it so that it could be folded into a compact configuration for off-site, transport, storage, and/or disposal. Reasonable and obvious variations in the content and sequencing of the steps of installation and removal disclosed herein are also considered to be within the scope of the method of the present invention.

What is claimed is:

1. A system for rapid attachment and removal of a ball-retaining sports net having a top edge, two vertically extending side edges, two horizontally extending lower side edges, and a plurality of openings therethrough, to and from a soccer goal frame, with each of the edges having a central portion and opposing ends, said system comprising:

elongated means adapted for stiffening the top edge, two vertically extending side edges, two horizontally extending side edges of the ball-retaining sports net;

a plurality of anchoring devices adapted for connecting said elongated means to a soccer goal frame with four of said anchoring devices being located on the frame in positions convenient for attaching the opposing ends of the horizontally extending lower side edges of the net to the frame, two of said anchoring devices being located on the frame in positions convenient for attaching the opposing ends of the top edge of the net to the frame, and at least two additional ones of said anchoring devices being located on the frame in positions spaced apart from one another and spaced apart from other ones of said anchoring devices so as to be convenient for attaching the central portion of the net's top edge to the frame, and with all of said anchoring devices being positions remote to contact by people situated under the net when it is attached in its usable position to the soccer goal frame;

a first attachment means adapted for connecting each of said anchoring devices to the soccer goal frame; and a second attachment means adapted for connecting said elongated means to the ball-retaining sports net so that when the net is extended into its usable position over the soccer goal frame, the front and side edges of the net can be firmly secured against the soccer goal frame during game play.

2. The system of claim 1 wherein said elongated means is selected from a group consisting of non-stretchable cords, cables, stretchable cords, and cords having a stretchable segment.

3. The system of claim 1 wherein said elongated means is selected from a group consisting of one cord, one cable, two cords, two cables, three cords, three cables, four cords, four cables, five cords, five cables, two cords and one cable, two cables and one cord, two cords and two cables, three cords and one cable, three cables and one cord, three cords and two cables, three cables and two cords, four cords and one cable, and four cables and one cord.

4. The system of claim 1 wherein said anchoring devices are selected from a group consisting of L-shaped brackets, anchoring brackets each having a central aperture, upright posts, rings, hooks, fastening devices adapted for holding the end of a cord tight against an adjacent portion of cord in a double-backed position, and holes formed in the soccer goal frame each adapted for insertion and fastening of at least one of said hooks.

5. The system of claim 1 wherein said second attachment means is selected from a group consisting of filaments, twine, lightweight rope, lightweight chain, and corrosion-resistant wire.

6. The system of claim 1 wherein said first attachment means is selected from a group consisting of rivets, screws, welding, adhesives, bonding materials, and depending threaded connectors.

7. The system of claim 1 providing a theft-resistant embodiment wherein said elongated means comprises one cable having opposed ends; wherein said anchoring devices comprise eight anchoring brackets each having a central aperture; wherein said anchoring devices also comprise two fastening devices that are each adapted for holding one of said opposed ends of said cable tight against an adjacent portion of said cable in a double-backed position; wherein said first attachment means is selected from a group consisting of rivets, screws, welding, adhesives, bonding materials, and depending threaded connectors; and wherein said second attachment means is selected from a group consisting of filaments, twine, lightweight rope, lightweight chain, and corrosion-resistant wire.

8. The system of claim 1 providing a first temporarily attached embodiment wherein said elongated means comprises three stretchable cords each having opposite ends; wherein said anchoring devices comprise six hooks, four holes formed in the soccer goal frame each located in a position convenient for attaching a different one of the opposing ends of the horizontally extending lower side edges of the net to the frame, six fastening devices that are each adapted for holding one of said opposite ends tight against an adjacent portion of one of said stretchable cords in a double-backed position, two upright posts, and two L-shaped brackets; wherein said second attachment means comprises a woven configuration between each of said cords and adjacent ones of the openings in the front and side edges of the ball-retaining sports net; and wherein said first attachment means is selected from a group consisting of welding, adhesives, bonding materials, and depending threaded connectors.

9. The system of claim 1 providing a second temporarily attached embodiment wherein said elongated means comprises five stretchable cords each having opposite ends; said anchoring devices comprise six hooks, four holes formed in the soccer goal frame each located in a position convenient for attaching a different one of the opposing ends of the horizontally extending lower side edges of the net to the frame, ten fastening devices that are each adapted for holding one of said opposite ends tight against an adjacent portion of one of said stretchable cords in a double-backed position, two upright posts, two rings, and two L-shaped brackets; wherein said second attachment means comprises a woven configuration between each of said cords and adjacent ones of the openings in the front and side edges of the soccer net; and wherein said first attachment means is selected from a group consisting of welding, adhesives, bonding materials, ring-post connection, and depending threaded connectors.

10. A system for rapid attachment and removal of a ball-retaining sports net having a top edge, two vertically extending side edges, two horizontally extending lower side edges, and a plurality of openings therethrough, to and from a soccer goal frame having a raised crossbar between two vertically extending front posts, as well as an upper support rearwardly extending from the top end of each front post, a lower support rearwardly extending from the bottom end of each front post, a lower crossbar between the back ends of the lower supports, and an oblique support behind each front post and connected between the back ends of one upper support and its adjacent lower support, said system comprising:

elongated means adapted for stiffening the front and side edges of a ball-retaining sports net;

a plurality of anchoring devices adapted for connecting said elongated means to a soccer goal frame with two of said anchoring devices being located on the frame in proximity to the connection between a different one of the front posts and the adjacent rearwardly extending lower support in positions convenient for attaching a first one of the opposing ends of each of the horizontally extending lower side edges of the net to the frame, two of said anchoring devices being located on the frame in proximity to the connection between one of the oblique supports and the adjacent rearwardly extending lower support in positions convenient for attaching the second one of the opposing ends of each of the horizontally extending lower side edges of the net to the frame, two of said anchoring devices being located on the frame in positions convenient for attaching the opposing ends of the top edge of the net to the frame, and at least two additional ones of said anchoring devices being located on the frame in positions spaced apart from one another and spaced apart from other ones of said anchoring devices so as to be convenient for attaching the central portion of the net's top edge to the frame, and with all of said anchoring devices being positions remote to contact by people situated under the net when it is attached in its usable position to the soccer goal frame;

a first attachment means adapted for connecting each of said anchoring devices to a soccer goal frame; and a second attachment means adapted for connecting said elongated means to the ball-retaining sports net so that when the net is extended into its usable position over the soccer goal frame, during game play the top edges of the net can be firmly secured against the raised crossbar while the side edges of the net are each firmly secured against a different one of the lower supports and the vertically extending front posts.

11. The system of claim 10 providing a theft-resistant embodiment wherein said elongated means comprises one cable having opposite ends; wherein said anchoring devices comprise eight anchoring brackets each having a central aperture; wherein said anchoring devices also comprise two fastening devices that each are adapted for holding one of said opposite ends of said cable tight against an adjacent portion of said cable in a double-backed position; wherein said first attachment means is selected from a group consisting of rivets, screws, welding, adhesives, bonding materials, and depending threaded connectors; and wherein said second attachment means is selected from a group consisting of filaments, twine, lightweight rope, lightweight chain, and corrosion-resistant wire.

12. The system of claim 10 providing a first temporarily attached embodiment wherein said elongated means comprises three stretchable cords each having opposite ends; wherein said anchoring devices comprise six hooks, four apertures formed in the soccer goal frame with two of said apertures in proximity to the connection between a different one of the front posts and the adjacent rearwardly extending lower support in positions convenient for attaching a first one of the opposing ends of each of the horizontally extending lower side edges of the net to the frame, and the remaining two of said apertures being in proximity to the connection between one of the oblique supports and the adjacent rearwardly extending lower support in positions convenient for attaching the second one of the opposing ends of each of the horizontally extending lower side edges of the net to the frame, six fastening devices that are each adapted for holding one of said opposite ends tight against an adjacent portion of one of said stretchable cords in a double-backed position, two upright posts, and two L-shaped brackets; wherein said second attachment means comprises a woven configuration between each of said cords and adjacent ones of the openings in the front and side edges of the soccer net; and wherein said first attachment means is selected from a group consisting of welding, adhesives, bonding materials, and depending threaded connectors.

13. The system of claim 10 providing a second temporarily attached embodiment wherein said elongated means comprises five stretchable cords each having opposite ends; wherein said anchoring devices comprise six hooks, four apertures formed in the soccer goal frame with two of said apertures in proximity to the connection between a different one of the front posts and the adjacent rearwardly extending lower support in positions convenient for attaching a first one of the opposing ends of each of the horizontally extending lower side edges of the net to the frame, and the remaining two of said apertures being in proximity to the connection between one of the oblique supports and the adjacent rearwardly extending lower support in positions convenient for attaching the second one of the opposing ends of each of the horizontally extending lower side edges of the net to the frame, ten fastening devices that are each adapted for holding one of said opposite ends tight against an adjacent portion of one of said stretchable cords in a double-backed position, two upright posts, two rings, and two L-shaped brackets; wherein said second attachment means comprises a woven configuration between each of said cords and adjacent ones of the openings in the front and side edges of the soccer net; and wherein said first attachment means is selected from a group consisting of welding, adhesives, bonding materials, ring-post connection, and depending threaded connectors so as to provide a second temporarily attached embodiment of said system.

14. A method for rapid attachment and removal of a ball-retaining sports net to and from a soccer goal frame, said method comprising the steps of:

providing a soccer goal frame having a raised crossbar, two vertically extending front posts, two rearwardly extending oblique supports, and two rearwardly extending lower supports, a ball-retaining sports net with front and side edges and a plurality of openings therethrough, elongated means adapted for stiffening said front and side edges of said net, a plurality of anchoring devices; a first attachment means; and a second attachment means;

using said first attachment means to connect each of said anchoring devices to said soccer goal frame in spaced-apart positions from one another on said soccer goal frame with at least two of said anchoring devices being attached centrally to said raised crossbar with two of said anchoring devices being located on the frame in proximity to the connection between a different one of the front posts and the adjacent rearwardly extending lower support in positions convenient for attaching a first one of the opposing ends of each of the horizontally extending lower side edges of the net to the frame, two of said anchoring devices being located on the frame in proximity to the connection between one of the oblique supports and the adjacent rearwardly extending lower support in positions convenient for attaching the second one of the opposing ends of each of the horizontally extending lower side edges of the net to the frame, two of said anchoring devices being located on the frame in proximity to the connection between a different one of the front posts and the raised crossbar in positions convenient for attaching the opposing ends of the top edge of the net to the frame, and at least two additional ones of said anchoring devices being located on the frame in positions spaced apart from one another and other ones of said anchoring devices which are convenient for attaching the central portion of the top edge of the net to the raised crossbar of the frame, and with all of said anchoring devices being positions remote to contact by people situated under the net when it is attached to the soccer goal frame;

using said second attachment means to connect said elongated means to said net;

extending said net into its usable position over said soccer goal frame;

using said anchoring devices to connect said elongated means to said soccer goal frame so that during game play said front edges of said net are firmly secured against said raised crossbar, and said side edges of said net are each firmly secured against a different one of said rearwardly extending lower supports and said vertically extending front posts.

15. The method of claim 14 wherein said step of providing said elongated means comprises the providing of one cable having opposite ends; wherein said step of providing said anchoring devices comprises the providing of eight anchoring brackets each having a central aperture and two fastening devices that each are adapted for holding one of said opposite ends of said cable tight against an adjacent portion of said cable in a double-backed position; wherein said step of providing said first attachment means comprises the providing of rivets, screws, welding, adhesives, bonding materials, and depending threaded connectors; and wherein said step of providing said second attachment means comprises the providing of filaments, twine, lightweight rope, lightweight chain, and corrosion-resistant wire; and wherein said step of using said anchoring devices to connect said elongated means to said soccer goal frame comprises the steps of inserting said cable through said central apertures in all of said anchoring brackets, doubling back each of said opposite ends of said cable upon adjacent portions of said cable, and securing each of said doubled back ends with one of said fastening devices to said adjacent portions of said cable, and wherein said steps of inserting, doubling back, and securing occur prior to said step of using said second attachment means, and further wherein removal of said net from said soccer goal frame comprises the steps of separating said net from said cable, pulling said net away from said soccer goal frame, optionally leaving said cable connected to said soccer goal frame, and when it is desired to also remove said cable from said soccer goal frame said method also comprising the steps of removing said fastening devices from both of said opposed ends of said cable, and slipping said cable out of said central apertures of each of said eight anchoring brackets.

16. The method of claim 14 wherein said step of providing said elongated means comprises the providing of three stretchable cords each having opposite ends; wherein said step of providing said anchoring devices comprises the providing of six hooks, four holes formed in said soccer goal frame each positioned near to a different one of said opposite ends of said rearwardly extending lower supports, six fastening devices that are each adapted to hold one of said opposite ends tight against an adjacent portion of one of said stretchable cords in a double-backed position, two upright posts, and two L-shaped brackets; wherein said step of providing said second attachment means comprises the providing of a woven configuration between each of said cords and adjacent ones of the openings in the front and side edges of said net; wherein said step of providing first attachment means comprises the providing of welding, adhesives, bonding materials, and depending threaded connectors, wherein said two anchoring devices connected centrally to said raised crossbar each comprise one of said L-shaped brackets and two of said raised attachment points comprise upright posts; wherein said step of using said anchoring devices to connect said elongated means to said soccer goal frame comprises the steps of securing each of said opposite ends to a different one of said hooks with one of said fastening devices, inserting said hooks into adjacent ones of said holes formed in said lower supports, securing said front edge of said net and one of said cords over said L-shaped brackets, and placing said front edge of said net and one of said cords between said upright posts and said vertically extending front posts, and further wherein removal of said net from said soccer goal frame comprises the steps of lifting said net and one of said cords away from said L-shaped brackets, lifting said net and one of said cords away from said upright posts, disconnecting said hooks from said holes in said lower supports, and pulling said net and said cords simultaneously away from said soccer goal frame.

17. The method of claim 14 wherein said step of providing said elongated means comprises the providing of five stretchable cords each having opposite ends; wherein said step of providing said anchoring devices comprises the providing of six hooks, four holes formed in said soccer goal frame each positioned near to a different one of said opposing ends of said rearwardly extending lower supports of said soccer goal frame, ten fastening devices that are each adapted to hold one of said opposite ends tight against an adjacent portion of one of said stretchable cords in a double-backed position, two upright posts, two rings, and two L-shaped brackets; wherein said step of providing said second attachment means comprises the providing of a woven configuration between each of said cords and adjacent ones of said openings in said front and side edges of said net; wherein said step of providing said first attachment means comprises the providing of welding, adhesives, bonding materials, ring-post connection, and depending threaded connectors; wherein said two anchoring devices connected centrally to said raised crossbar each comprise one of said L-shaped brackets and two of said raised attachment points comprise upright posts; wherein said step of using said anchoring devices to connect said elongated means to said soccer goal frame comprises the steps of securing each of said opposite ends of two of said cords to a different one of said hooks with one of said fastening devices, using one of said fastening devices to secure one of said opposite ends of two additional ones of said cords to a different one of said hooks and the other of said opposite ends to a different one of said rings, using one of said fastening devices to secure each of said opposite ends of the fifth one of said cords to a different one of said rings, inserting said hooks into adjacent ones of said holes formed in said lower supports, securing said front edge of said net and one of said cords over said L-shaped brackets, and placing said front edge of said net and a different one of said rings over each of said upright posts, and further wherein removal of said net from said soccer goal frame comprises the steps of lifting said net and one of said cords away from said L-shaped brackets, lifting said net and one of said rings away from each of said upright posts, disconnecting said hooks from said holes in said lower supports, and pulling said ball-retaining sports net and said cords simultaneously away from said soccer goal frame.

* * * * *

UNITED STATES PATENT AND TRADEMARK OFFICE

CERTIFICATE OF CORRECTION

PATENT NO. : 6,383,096 B1
DATED : May 7, 2002
INVENTOR(S) : Robert R. Green

It is certified that error appears in the above-identified patent and that said Letters Patent is hereby corrected as shown below:

Column 15,
Line 41, after the words "both ends of cord" delete the word "if" and replace with -- 1*f* --
Line 65, after the words "the third embodiment" delete the word "Into"

Column 16,
Line 1, after the words "1*d*, 1*e* and" delete the word "if" and replace with -- 1*f* --
Line 44, after the words "securing one end of cord" delete the word "if" and replace with -- 1*f* --
Line 53, after the words "release cord" delete the word "if" and replace with -- 1*f* --
Line 57, after the words "1*b*, 1*c*, 1*d*, 1*e* and" delete the word "if" and replace with -- 1*f* --

Column 18,
Line 44, after the words "Cord 1*a* or" delete the word "if" and replace with -- 1*f* --

Column 19,
Line 8, after the words "slip cord 1*a* or" delete the word "if" and replace with -- 1*f* --

Signed and Sealed this

First Day of October, 2002

*Attest:*

*Attesting Officer*

JAMES E. ROGAN
*Director of the United States Patent and Trademark Office*